United States Patent [19]

Allen

[11] Patent Number: 4,930,781

[45] Date of Patent: Jun. 5, 1990

[54] CONSTANT RESONANT FREQUENCY GOLF CLUB HEAD

[76] Inventor: Dillis V. Allen, 240 Lincolnshire Ct., Schaumburg, Ill. 60193

[21] Appl. No.: 232,960

[22] Filed: Aug. 17, 1988

[51] Int. Cl.[5] ..... A63B 53/04; B22D 19/00; B22C 9/00

[52] U.S. Cl. ..... 273/167 F; 273/78; 273/169; 273/167 H; 164/34; 164/361

[58] Field of Search ..... 273/167–175; 428/593; 164/98, 34, 246, 361, 363

[56] References Cited

U.S. PATENT DOCUMENTS

| | | | |
|---|---|---|---|
| 1,592,463 | 7/1926 | Marker | 273/173 |
| 1,658,581 | 2/1928 | Tobia | 273/167 |
| 1,678,637 | 7/1928 | Drevitson | 273/173 |
| 1,825,244 | 9/1931 | Nero | 273/170 |
| 2,460,435 | 2/1949 | Schaffer | 273/169 |
| 2,592,013 | 4/1952 | Curley | 273/170 |
| 3,637,218 | 1/1972 | Carlino | 273/168 |
| 3,693,978 | 9/1972 | East | 273/167 F |
| 3,847,399 | 11/1974 | Raymont | 273/167 F |
| 4,021,047 | 5/1977 | Mader | 273/167 H |
| 4,076,254 | 2/1978 | Nygren | 273/173 |
| 4,214,754 | 7/1980 | Zebelean | 273/167 H |
| 4,313,607 | 2/1982 | Thompson | 273/167 H |
| 4,438,931 | 3/1984 | Motomiya | 273/167 H |
| 4,449,707 | 5/1984 | Hayashi et al. | 273/171 |
| 4,535,990 | 8/1985 | Yamada | 273/173 |
| 4,645,207 | 2/1987 | Teramoto et al. | 273/77 A |
| 4,679,792 | 7/1987 | Straza et al. | 273/78 |
| 4,681,321 | 7/1987 | Chen et al. | 273/167 H |
| 4,730,803 | 3/1988 | Tilley | 273/171 |
| 4,824,110 | 4/1989 | Kobayashi | 273/78 |

FOREIGN PATENT DOCUMENTS

| | | | |
|---|---|---|---|
| 2200558 | 8/1988 | United Kingdom | 273/77 A |

OTHER PUBLICATIONS

"The Solid Ones" as seen in *Golf Digest,* Jul. 1973, p. 76.

*Primary Examiner*—Edward M. Coven
*Assistant Examiner*—Sebastiano Passaniti

[57] ABSTRACT

A metallic golf club head formed with a one-piece thin-walled forward body including a ball striking face, a perimeter wall having a uniform rearward depth and a hosel, and a rear cover that encloses the perimeter wall.

12 Claims, 5 Drawing Sheets

CONSTANT RESONANT FREQUENCY GOLF CLUB HEAD

RELATED APPLICATIONS

This application relates to the functional feature of golf clubs whose overall appearance is covered in my U.S. Design Patent Applications entitled GOLF CLUB HEAD, Case 1, U.S. Ser. No. 232884, Filed 08/17/88; and GOLF CLUB HEAD, Case 2, U.S. Ser. No. 232885, Filed 08/17/88.

BACKGROUND OF THE INVENTION

Perimeter-weighted investment cast metal golf clubs, both wooden and iron shaped clubs, have found increasing popularity in the marketplace replacing solid core woods and forged irons.

These perimeter-weighted clubs have achieved marketplace success for a variety of reasons including a marketplace perception that off-center hits with perimeter weighted club heads yield far better results than with off-center hits on solid wooden club heads and forged irons. Perimeter-weighted club heads usually include a rather thin forward ball in the hitting area bounded by a much heavier wall, either thicker or longer, around the perimeter of the forward wall. In the case of perimeter-weighted metal woods, the perimeter ball has a thickness on the order of 0.060 to 0.090 inches, somewhat less than the forward wall, but because of its large bell-shaped configuration, has considerable weight severely reducing the resiliency of the club face at the perimeter of the forward wall giving the golfer a stiffer feel for off-center hits near the perimeter wall.

In perimeter-weighted irons, the perimeter weight is increased by thickening the perimeter wall both parallel and normal to the face, but in either case the result is the same; i.e., increased club head weight around the perimeter of the forward wall and decreased forward wall thickness in the hitting area.

The combination of a heavy perimeter wall and a thin central wall in the ball striking area produces a result similar to a tennis racquet effect where the ball deflects the forward wall rearwardly at impact hugs the ball for about 15 milliseconds and slings it forwardly off the club face. This is sometimes also referred to as a banjo effect.

While most players sincerely believe these perimeter-weighted woods and irons to be more forgiving for off-center hits, the results produced by off-center hits are inconsistent both in terms of ball velocity and "feel". This is because the deflection of this thin forward wall varies dramatically between impact points at the center of the club and impact points moving outwardly from that center toward the perimeter.

I discovered this phenomenon as a result of testing club face deflection in a perimeter-weighted stainless steel wood while attempting to build electronics into the club face to compute ball distance traveled. I found this computation difficult because club face deflection was at a maximum of 100 um$\times$k (where k is the constant), at the club face center while only 20 um$\times$k at the perimeter for exactly the same impact force. This drastic reduction in sling shot effect may give the golfer a somewhat more rigid feel for hits near the perimeter wall but also results in a significant velocity decrease because of the reduction in sling shot effect.

Because of this problem, I found it desirable to design a golf club head that would have uniform force deflection characteristics across the entire club face, i.e., not only at the center of the club face but moving outwardly from the center toward the periphery.

Perimeter-weighted investment cast woods and irons have principally found success in the marketplace because of ease of manufacture, and only to a lesser extent the improved off-center hit characteristic. The cost reduction is due to the fact that these perimeter-weighted clubs can be easily investment cast, sometimes referred to as a lost wax process, in which rather complex iron configurations and hollow thin-walled metal woods can be molded utilizing wax patterns frequently formed with inexpensive epoxy thermo-setting masters.

Perimeter-weighted metal woods, and particularly those formed of stainless steel today usually have forward walls on the order of .100 to 0.125 inches in thickness and perimeter walls on the order of 0.050 to 0.080. Bearing in mind that overall club head weight of a metal wood must be in the range of 13 to 13.5 oz. for useability by professionals and amateurs, early attempts at designing investment cast metal woods produced forward walls less than 0.100 inches in thickness and these frequently failed under impact loads. In early efforts to minimize this problem without adding thickness to the forward wall, various shaped partitions were devised across the forward wall to give it added strength. It should be understood, however, that all these attempts at partitioning the forward wall were for the sole purpose of strengthening an already too thin forward wall.

Another distinguishing characteristic in these earlier partitioning efforts is that the investment cast woods were and in fact are presently formed of a main upper body and hosel and a lower sole plate joined together by welding. It is necessary in the investment casting process that a collapsible core piece be provided to form the hollow thin-walled interior since the hollow interior is significantly larger than the sole plate. Because the sole plate covers an opening in the lower part of the body, the core piece is removed by first collapsing it and then pulling it vertically downwardly. This required collapsing and withdrawal movement of the investment casting core piece severely restricts the configuration of any partitioning extending from the forward wall because the core piece must be able to also withdraw from and clear the partitioning also.

An early attempt at perimeter-weighting and front face strengthening is shown in the Raymont, U.S. Pat. No. 3,847,399, although Raymont shows his partitioning in wooden clubs only for hollowed out natural wood bodies. His iron configuration, however, is perimeter-weighted in a style similar to many perimeter-weighted clubs found today with a thin-walled central face and a heavy, thick surrounding perimeter wall. The central area of the forward face is strengthened by rearwardly extending partitions having the configuration of honeycombing. This honeycombing, however, is for the sole purpose of strengthening the forward face and not minimizing the effect of perimeter weighting. Furthermore, this partitioning extends over only the central portion of the club face and not entirely across it. Raymont also envisioned partitions for rigidifying the forward face in wooden clubs, but he only appreciated its application to natural wooden club heads and not to thin wall investment cast metal woods.

Similar strengthening partitioning in golf club heads are shown in the Marker, U.S. Pat. No. 1,592,463; the Tobia, U.S. Pat. No. 1,658,581; the Drevitson, U.S. Pat.

No. 1,678,637; the Schaffer, U.S. Pat. No. 2,460,435; the Curley, U.S. Pat. No. 2,592,013; the Mader, U.S. Pat. No. 4,021,047; the Nygren, U.S. Pat. No. 4,076,254; the Zebelean, U.S. Pat. No. 4,214,754; the Motomiya, U.S. Pat. No. 4,438,931; the Hayashi et al. U.S. Pat. No. 4,449,707; the Yamada U.S. Pat. No. 4,535,990; the Teramoto, et al., U.S. Pat. No. 4,645,207; the Straza, et al., U.S. Pat. No. 4,679,792; the Chen, et al., U.S. Pat. No. 4,681,321, and the Tilley, U.S. Pat. No. 4,730,830. There have also been attempts to provide club heads with rear covers, such as shown in the Nero, U.S. Pat. No. 1,825,244, and the Carlino, U.S. Pat. No. 3,637,218, but these attempts have not been applied to thin walled investment cast club heads, and thus not directed to any of the problems in that casting art.

There have also been attempts to manufacture wooden clubs with narrow faces such as the one shown in the East, U.S. Pat. No. 3,693,978, but these have not suggested shaping the rear wall in a wooden club complementary and parallel to the forward ball striking face.

SUMMARY OF THE PRESENT INVENTION

According to the present invention, a metallic golf club head is provided with a uniform thickness body having in two embodiments a series of uniform symmetrically arranged partitions that dramatically increase the effective thickness of the forward face and provide the forward face with a substantially constant resonant frequency over its entire surface. It results, in effect, in a club face that is the antithesis of or opposite lo perimeter weighting where instead of having excessive weight at the perimeter, club head weight is uniformly distributed across the forward surface. In a third embodiment uniform equivalent thickness across the face is achieved without partitions by a back plate that is parallel to the forward face.

It should be understood that the terms metal, and metallic refer to moldable and castable materials exhibiting similar properties to stainless steel in the club head environment and include ceramic and graphite materials.

These principles are achieved in the first two embodiments by forming a labyrinth of partitions and the perimeter wall itself with substantially the same wall thicknesses and extending both rearwardly the same distance from the forward face, on the order of ⅝ths to 15/16ths of an inch in wooden clubs, and covering the resulting rearward opening with a rear cover plate.

In the first embodiment, the rear cover plate has the outer configuration of a conventional wooden club and is investment cast stainless steel with a wall thickness approximating that of the body. This cover adds some perimeter weighting to the body but moves the center of gravity for the assembled club rearwardly which assists in promoting a hooking action for the club head making it easier to swing for the amateur player.

In the second embodiment, the rear cover plate is generally flat with a roll and bulge complementary to the forward face of the club face, and this cover plate is attached not only to the perimeter wall of the body but the partitions as well providing an extremely solid hitting area across the entire club face. The body with the cover plate attached has the same axial effective thickness all across the club face.

Another advantage in the first two embodiments is that the long partitions, i.e., long in a rearward direction from the club face, move the center of gravity of the overall club assembly forward considerably over true wooden clubs and investment cast metal woods. The effect of this is to change the conventional dynamics of wooden clubs more toward the dynamics of iron clubs making them considerably easier to use for those players who prefer and are more comfortable with iron clubs. Furthermore, this shifting of the center of gravity forwardly in the present club increases the utility of the club as a fairway wood because it facilitates a slight downward striking action of the ball in the fairway.

In a third embodiment of the present invention a generally flat cover plate is provided and the club head has a shape the same as the second embodiment, but no partitions are provided on the forward wall. By eliminating the partitions, the cover plate can be substantially thicker thereby shifting the center of gravity rearwardly enhancing hooking action for the amateur player. This embodiment, while not reducing perimeter weighting has constant effective thickness across the club face.

Resonant frequency of a particle, and in this case the club head body, is inversely proportional to the thickness or mass M of the particle in the direction parallel to the force of impact. By dramatically increasing the effective thickness of the club face according to the present invention in a direction normal to the club face, resonant frequency is similarly drastically reduced as is the amplitude of forced vibration giving the club head a far more solid feel than any perimeter-weighted metal wood thus far designed, and because this very thick effective club face is the same all across the face, the golfer gets the same consistent feel for hits anywhere on the face.

While partitioning the forward face of a thin-shelled metal wood has been known in the past as discussed above, such attempts, because the partitions are relatively narrow in a direction normal to the club face, have not reduced the effect of perimeter weighting because they have been utilized to enable the club to have a thinner forward ball in an effort to provide a lighter club with an equivalently strong club face.

Other objects and advantages of the present invention will appear from the following detailed description of the invention.

DETAILED DESCRIPTION OF THE PREFERRED EMBODIMENTS

Figure 1:
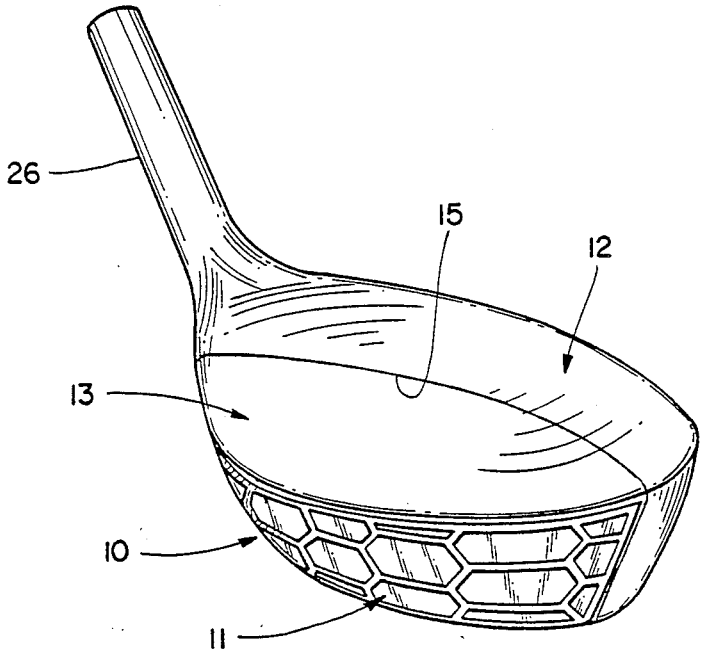
FIG. 1 is a perspective view of a club head according to the present invention.
Figure 2:
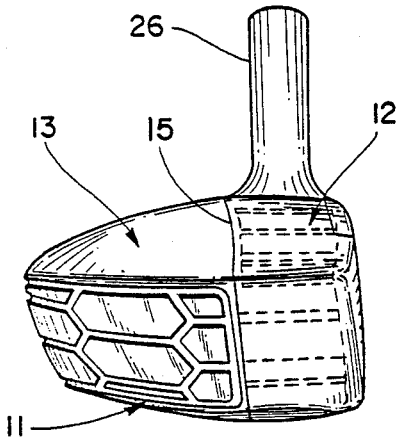
FIG. 2 is a left side view of the club head illustrated in FIG. 1.
Figure 3:
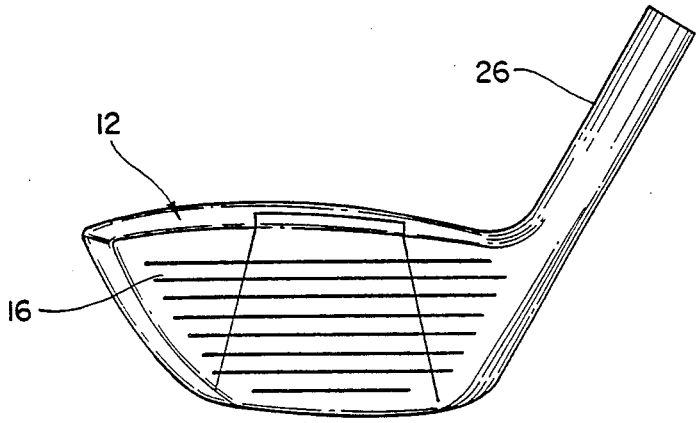
FIG. 3 is a front view of the club head illustrated in FIG. 1.
Figure 4:
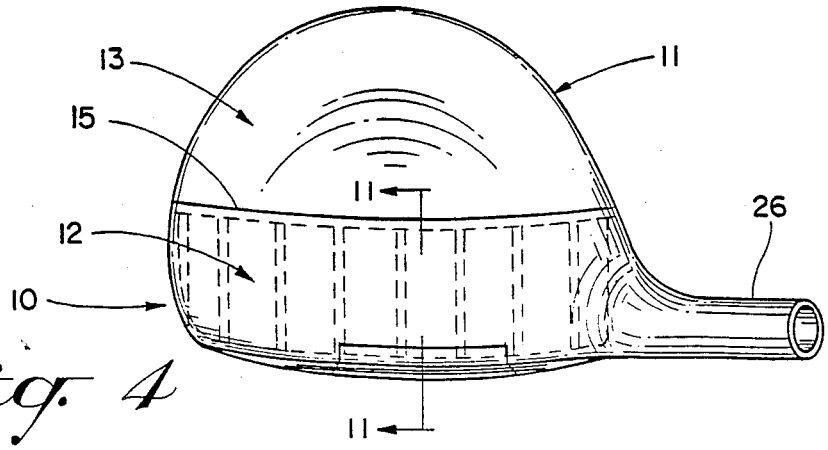
FIG. 4 is a top view of the club head illustrated in FIG. 1.
Figure 5:
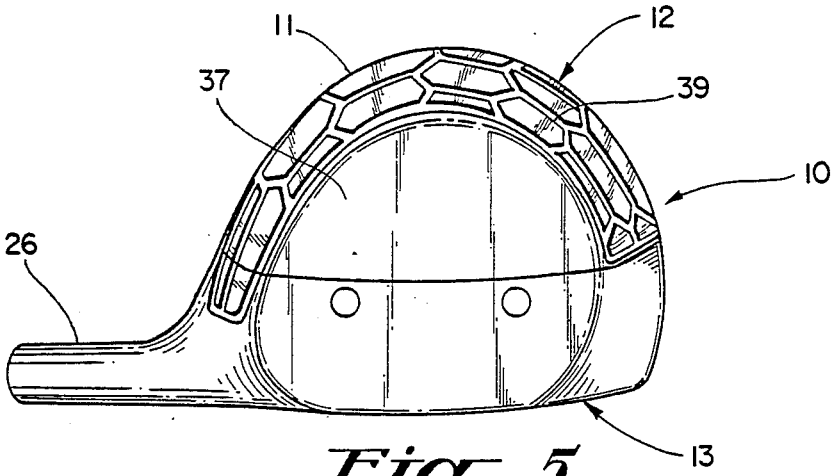
FIG. 5 is a bottom view of the club head illustrated in FIG. 1.
Figure 6:
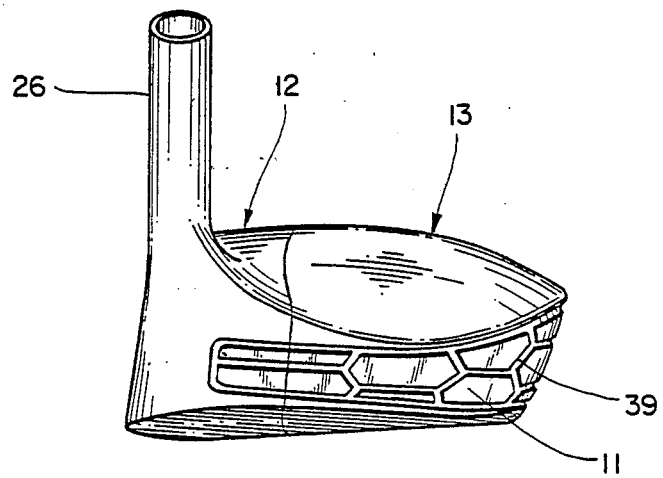
FIG. 6 is a right side view of the club head illustrated in FIG. 1.
Figure 7:
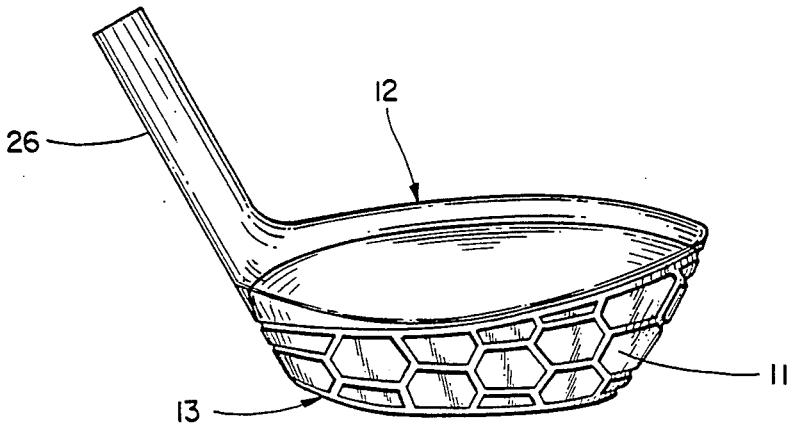
FIG. 7 is a rear view of the club head illustrated in FIG. 1.
Figure 8:
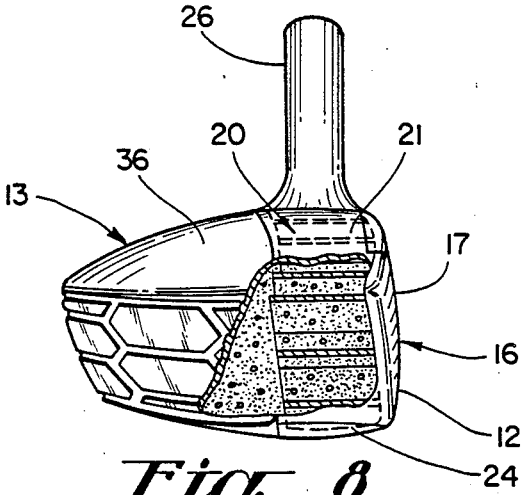
FIG. 8 is a left side view of the club head shown in FIG. 1, partly broken away to show its interior.
Figure 9:
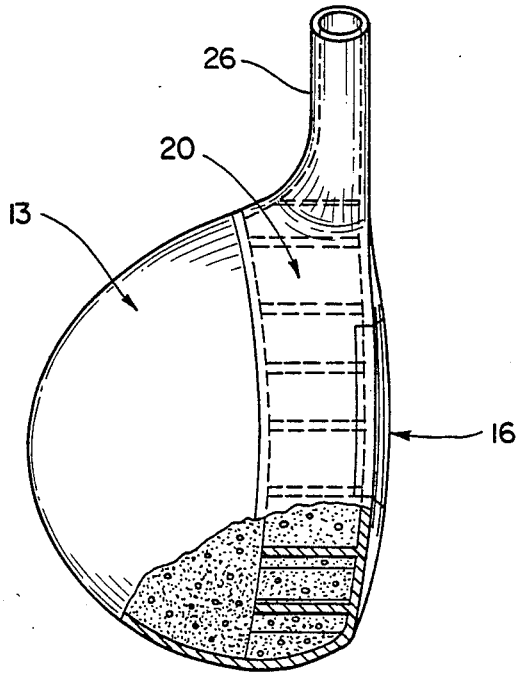
FIG. 9 is a top view of the club head shown in FIG. 1, partly borken away to show its interior.
Figure 10:
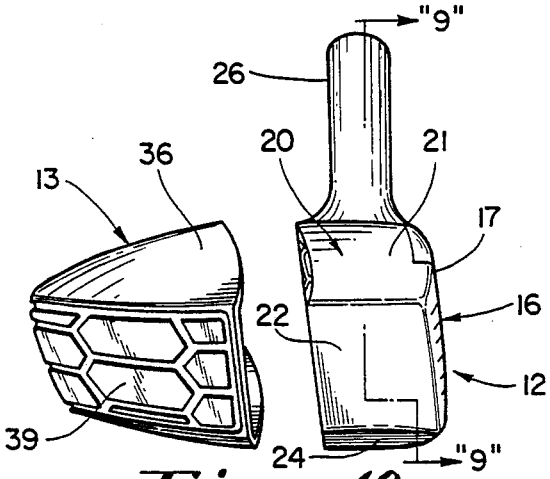
FIG. 10 is an exploded view of the body and cover illustrated in FIGS. 1 to 7.
Figure 11:
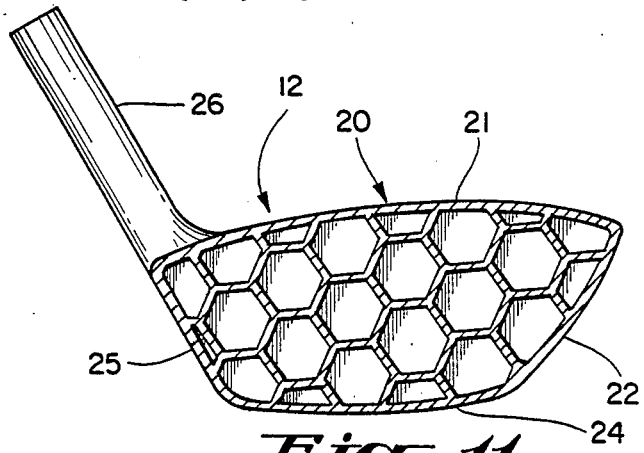
FIG. 11 is a cross section taken generally along line 9—9 of FIG. 10.
Figure 12:
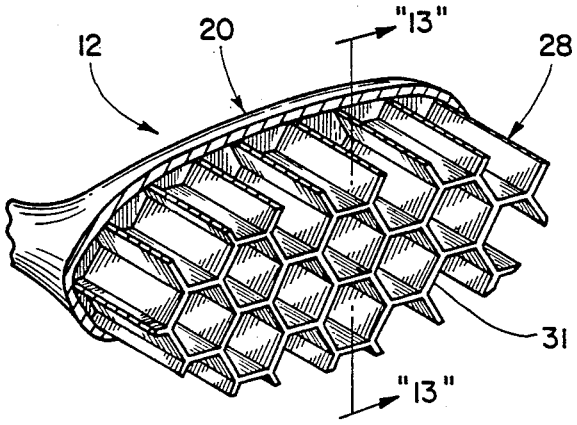
FIG. 12 is a perspective fragmentary view of the club head body illustrated in FIG. 10.

Referring to the drawings and particularly the embodiment illustrated in FIGS. 1 to 13 an investment cast stainless steel club head 10 is illustrated having a substantially conventional outer appearance except for a graphics engraved area 11 on the rear of the club. It should be understood that the outer appearance of club 10, as well as the outer appearance of the club head illustrated in FIGS. 12 to 15, are covered in my U.S. Design Applications referred to above in the Related Applications section of this application. It should also be understood with respect to the embodiment illustrated in FIGS. 14 to 18, that to the extent the outer configuration supports the function of the club head as one with a constant thickness across the club face it is covered in this application and not in the Design Applications.

Club head 10 includes a body 12 and a cover 13 both stainless steel investment castings that are joined together at parting line 15 by heliarc welding. The resulting weldment at line 15 is thereafter ground and the club head finished.

Figure 13:
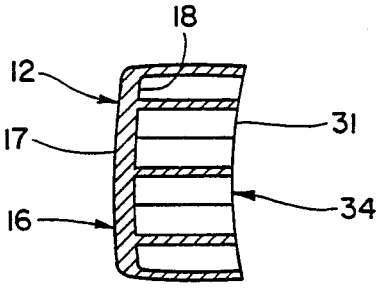
FIG. 13 is a fragmentary section taken generally along line 11—11 of FIG. 4.
Figure 14:
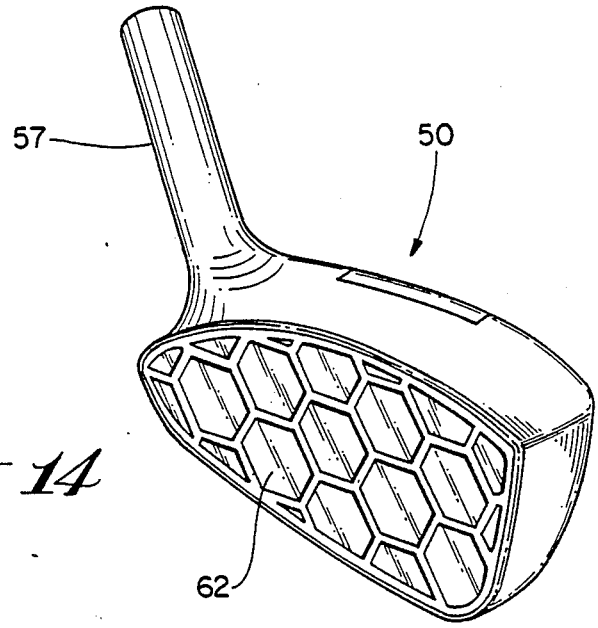
FIG. 14 is a perspective view of another embodiment of the present club head.
Figure 15:
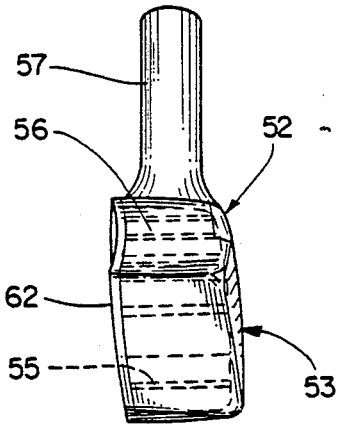
FIG. 15 is a left side view of the club head illustrated in FIG. 14.
Figure 16:
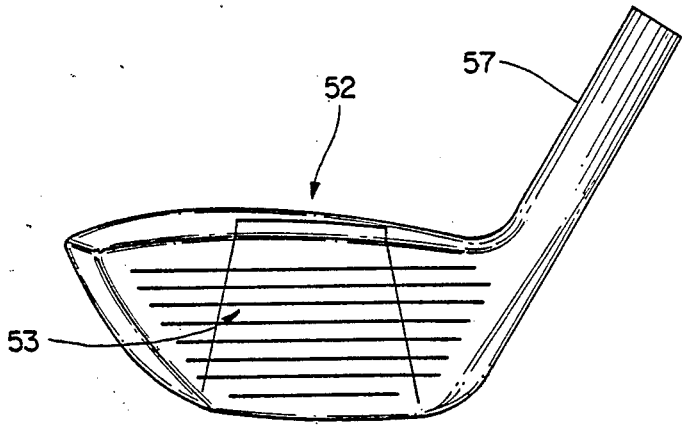
FIG. 16 is a front view of the club head illustrated in FIG. 14.
Figure 17:
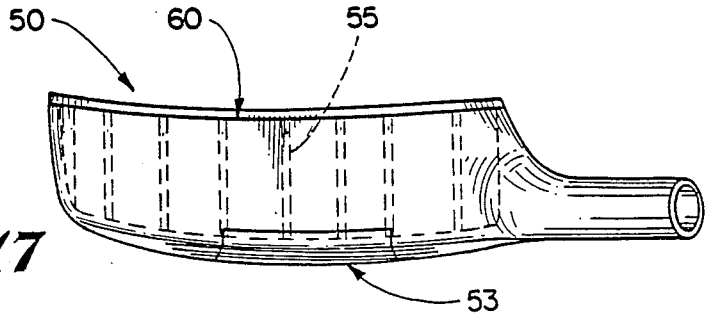
FIG. 17 is a top view of the club head illustrated in FIG. 14.
Figure 18:
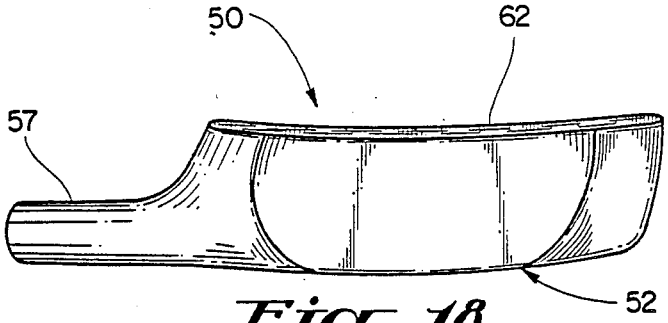
FIG. 18 is a bottom view of the club head illustrated in FIG. 14.
Figure 19:
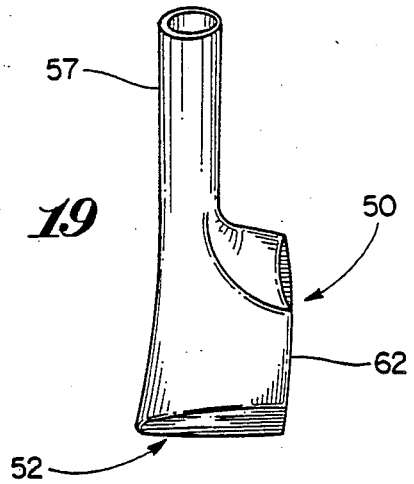
FIG. 19 is a right side view of the club head illustrated in FIG. 14.
Figure 21:
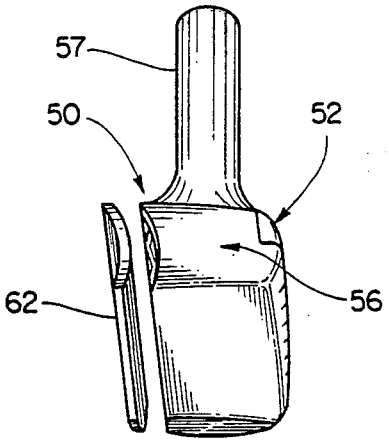
FIG. 21 is an exploded left side view of the club head illustrated in FIGS. 14 to 20.
Figure 20:
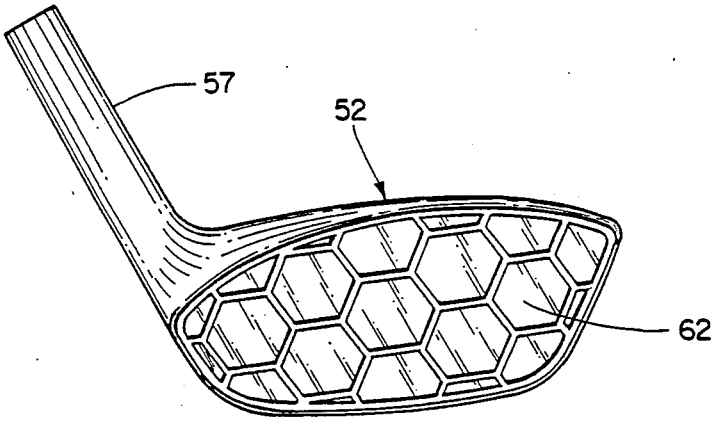
FIG. 20 is a rear view of the club head illustrated in FIG. 14.

Body 12 includes a forward ball striking wall 16 having a forward face 17 and a rear face 18 (see FIG. 13). Forward face 17 and rear face 18 are parallel and spaced apart so that the forward wall 18 has a thickness of approximately 0.125 inches, which is in the range of contemporary stainless steel perimeter-weighted investment cast club faces that have no infra structure.

The forward wall 16 is surrounded by a perimeter rearwardly extending wall 20 having a top wall 21, a left side wall 23, a bottom ball 24, and a right side wall 25. A hosel 26 projects upwardly from top wall 21 in conventional fashion. The perimeter wall has a thickness in the range of 0.040 to 0.065 inches.

The interior of the perimeter wall 20 is completely filled with a labyrinth of partitions 28 in the form of a hexagonal complex of stainless steel walls investment cast integrally with both forward wall 16 and perimeter wall 20 providing an extremely solid and rigid structure. The labyrinth of partitions 28 is comprised of a plurality of individual flat rectangular wall portions 31 having a thickness on the order of 0.015 to 0.040 and a length normal to face 16 in the range of ⅝ths to 15/16ths inches. The wall thickness of segments or wall portions 31 can be controlled and varied to change the weight of the club as can the length of the wall portions normal lo the forward wall 16.

The perimeter wall 21 and the labyrinth 28 end in a complex arcuate plane 34 shown in FIG. 13 that is complementary with and parallel to the forward face 17 of forward wall 16. This is what yields the constant resonant frequency along club face 17.

The cover 13, as seen in FIGS. 1 to 10 is generally cup-shaped in configuration and has a top wall 36, a bottom wall 37 and a frustoconical rear wall 39.

In the investment casting process for body 20, the core piece forming the partitions 28, the interior of perimeter wall 20, and the rear surface 18 of forward wall 16, collapses at certain points around the balls to clear any undercuts in the walls and then is withdrawn or pulled axially rearwardly from the labyrinth and the perimeter wall. Thereafter, the cover plate 13 is welded to the body and the club head finished.

By varying the shape of the cover 13, the center of gravity can be shifted forwardly and rearwardly as desired and also the overall club head weight can be varied as desired. The cover 13 has a wall thickness throughout similar to the thickness of perimeter wall 20.

A second embodiment of the present invention is illustrated in FIGS. 14 to 21. In FIGS. 12 to 19 another club head 50 is illustrated according to the present invention having a body 52 that is identical in configuration to the body 12 illustrated in the FIGS. 1 to 13 embodiments except that body 52 has a width normal to its forward wall 53 on the order of 1.00 inches which is greater than the width of body 21.

The body 52 includes a labyrinth of partitions 55 identical to a labyrinth 28 except for the increased width of body 52.

The body 52 includes a perimeter wall 56 and a hosel 57 also the same as the corresponding parts in the FIGS. 1 to 11 embodiment except for the width of perimeter ball 56 normal to wall 53. The labyrinth 55 and the perimeter wall 56 end in a body rear wall 60 having a roll and bulge complementary to forward wall 53. The rear wall 60 is closed by a cover plate 62 seen in FIGS. 14, 15, 17, 18 and 21 that has a complex curvature complementary and parallel to rear wall 60 and forward wall 53.

The result of this is that the assembly of the body 52 and the rear cover plate 62 results in an effective club head thickness of approximately 1.050 inches since cover plate 52 has a uniform thickness of substantially 0.049 inches.

The cover plate 62 is joined to the body 52 by heliarc welding around its perimeter wall 56 and also by welding it to the partitions 55 at selected points across rear wall 60. This provides an extremely solid and rigid structure having uniform effective thickness entirely across club face 53 in a direction normal thereto.

Body 52 and plate 62 are investment cast in a manner similar to body 12 and cover plate 13 in the FIG. 1 to 13 embodiment.

A third embodiment of the present invention is identical to the one illustrated in FIGS. 14 to 21, except that partitions 55 are eliminated and its cover plate is substantially thicker, on the order of 0.150 inches than cover plate 52. The thicker cover plate is possible because the partitions are eliminated and the added weight of the cover plate just equals the lost weight of the partitions, thus keeping overall club head weight the same. In all three embodiments club head weight is approximately 6.6 oz. unshafted and 13.0 to 13.5 oz.

shafted, not including 6 to 10 grams for polyurethane hydrophillic foam interiors.

In this third embodiment the club head is hollow except for foaming and the forward wall is on the order of 0.125 inches. While this results in enhanced perimeter weighting effect, it retains the advantages of constant incremental club head mass and constant incremental center of club head cut up in a plurality of grid-like square segments entirely across the club face extending normal to the face through the forward face rearwardly through the foam and through the rear cover, each of these segments would be identical, have substantially identical weight, have substantially identical length, and have substantially identical centers of mass.

I claim:

1. A metallic club head comprising: a one piece metallic body including a forward wall, a perimeter wall surrounding and extending rearwardly from the forward wall and a hosel extending generally upwardly from the perimeter wall, said perimeter wall having a substantially constant length normal to the forward wall and a rearwardly facing opening, and a one-piece cover for the perimeter wall opening, the forward wall having a forward face having a roll and bulge and a rear surface, and partitions extending integrally and rearwardly from the forward wall rear face, said partitions ending in a surface having a roll and bulge substantially the same as the forward face of the forward wall.

2. A metallic club head, comprising: a metallic body having a forward wall with a rear surface, a perimeter wall surrounding the forward wall and a hosel extending generally upwardly from the perimeter wall, a plurality of partitions extending rearwardly from and integral with the forward wall rear surfaces and the perimeter wall, said partitions extending substantially entirely across the forward wall and being formed integrally with the perimeter wall and extending a substantial distance rearwardly from the forward wall, and a rear cover attached to the perimeter wall.

3. A metallic club head as defined in claim 2, wherein the partitions have a symmetrical pattern and end in a partition wall parallel to the forward wall.

4. A metallic club head as defined in claim 2, wherein the perimeter wall ends coextensively with the partitions defining a rear body wall substantially parallel to the forward wall.

5. A metallic club head as defined in claim 2, wherein the cover has a shape complementary to the forward wall so that it is substantially parallel thereto.

6. A metallic club head as defined in claim 2, wherein the cover has a cup-shaped configuration substantially the same as conventional wood club heads.

7. A metallic club head comprising: a metallic body having a forward wall with roll and bulge and a rear surface, a perimeter wall surrounding the forward wall and a hosel extending generally upwardly from the perimeter wall, and a plurality of partitions extending rearwardly from and integral with the forward wall rear surface and perimeter wall, said partitions extending rearwardly substantially entirely across the forward wall and being formed integrally with the perimeter wall, said perimeter wall extending substantially coextensively with said partitions and defining a rear body wall having a roll and bulge complementary to the forward wall, and a rear cover member attached over the body rear wall.

8. A method of making a metallic club head, comprising: molding a metallic body having a forward wall with a rear surface with a plurality of integral partitions extending rearwardly from the rear surface and a perimeter wall extending rearwardly from the forward wall also integral with the partitions by investment casting with a collapsible core for the partitions and the inside surfaces of the perimeter wall and the forward wall, withdrawing the core from a wax equivalent in a rearward direction, and attaching a rear cover over the rear of a body formed from a mold made from the wax equivalent.

9. A method of making a metallic club head as defined in claim 8, including the step of forming the cover with a shape substantially complementary to the forward wall, and attaching the cover to the opening in the body so the cover is substantially parallel to the forward wall.

10. A metallic club head, comprising: a metallic body having a forward wall with a rear surface a perimeter wall surrounding the forward wall and a hosel extending generally upwardly from the perimeter wall, and a plurality of partitions extending rearwardly from and integral with the forward wall rear surface, said partitions extending substantially entirely across the forward wall and being formed integrally with the perimeter wall, said forward wall having a thickness at least 0.100 inches, said partitions extending rearwardly from the forward wall at least 0.250 inches.

11. A metallic club head, comprising: a one piece metallic body including a forward wall with a rear surface, a perimeter wall surrounding and extending rearwardly from the forward wall and a hosel extending generally upwardly from the perimeter wall, said perimeter wall having a rearwardly facing opening, a one-piece cover for the perimeter wall opening, and a plurality of symmetrical partitions extending rearwardly from and integral with the forward wall rear surface a substantial distance from the forward wall and ending substantially coextensively with the perimeter wall, said perimeter wall and said partitions ending in a rear wall parallel and complementary to the forward wall, said cover being attached to the rear wall.

12. An investment cast stainless steel metal "wood" club head comprising: a one-piece stainless steel investment casting having an opening for removal of an interior forming mold, said casting including a forward wall less than 0.125 inches in thickness having a forward ball striking surface and a rear surface, a plurality of clusters of reenforcing cells many of which are surrounded by other cells together forming a uniform pattern extending integrally and rearwardly from the rear surface of the forward wall, a perimeter wall extending integral from the forward wall having wall thickness in the range of 0.030 inches to 0.100 inches, and a cover plate attached over the opening in the casting, said reenforcing cells being constructed to reduce the weight of the forward wall permitting the saved weight to be added to the perimeter wall to strengthen the perimeter wall while maintaining club head integrity and overall weight.

* * * * *